US010633221B2

(12) United States Patent
Haipus

(10) Patent No.: US 10,633,221 B2
(45) Date of Patent: Apr. 28, 2020

(54) METHOD FOR USING AN ELEVATOR SYSTEM AND ELEVATOR SYSTEM HAVING FAST EMERGENCY EVACUATION OF A FLOOR

(71) Applicant: KONE Corporation, Helsinki (FI)

(72) Inventor: Ilpo Haipus, Nummela (FI)

(73) Assignee: KONE CORPORATION, Helsinki (FI)

( * ) Notice: Subject to any disclaimer, the term of this patent is extended or adjusted under 35 U.S.C. 154(b) by 251 days.

(21) Appl. No.: 15/360,643

(22) Filed: Nov. 23, 2016

(65) Prior Publication Data

US 2017/0073188 A1 Mar. 16, 2017

Related U.S. Application Data

(63) Continuation of application No. PCT/FI2014/050472, filed on Jun. 12, 2014.

(51) Int. Cl.
*B66B 5/02* (2006.01)
*B66B 1/24* (2006.01)

(52) U.S. Cl.
CPC ..... *B66B 5/021* (2013.01); *B66B 1/24* (2013.01); *B66B 5/024* (2013.01); *B66B 2201/40* (2013.01)

(58) Field of Classification Search
CPC combination set(s) only.
See application file for complete search history.

(56) References Cited

U.S. PATENT DOCUMENTS 5,979,607 A 11/1999 Allen
6,000,505 A * 12/1999 Allen ..... G06Q 90/205 187/391

(Continued)

FOREIGN PATENT DOCUMENTS

EP 1 433 735 A1 6/2004
EP 2 192 073 A1 6/2010
WO WO 2007/042605 A1 4/2007

*Primary Examiner* — Christopher Uhlir
(74) *Attorney, Agent, or Firm* — Birch, Stewart, Kolasch & Birch, LLP

(57) ABSTRACT

The invention relates to a method for using an elevator system in a building having several vertically spaced floors served by an elevator system, particularly by one or more vertically traveling elevator cars of an elevator system, said floors comprising at least a first floor, a second floor, and a plurality of intermediate floors positioned vertically between the first and second floor, the elevator system being configured to have several modes, including at least a normal operating mode and an evacuation operating mode, in which normal operating mode a car of the elevator system is used to serve a first set of floors, and in which evacuation operating mode said elevator car is used to serve a second set of floors different from said first set of floors; the method comprising evacuating passengers from the first floor to the second floor, the evacuating comprising changing the mode of the elevator system from the normal operating mode to the evacuation operating mode; and determining the second set of floors to include the first floor and an intermediate stop floor from amongst the plurality of intermediate floors or a subset thereof; and transporting a load of passengers from the first floor with said elevator car without intermediate stops to said intermediate stop floor; and repeating one or more times said transporting a load of passengers from the first floor; and after one or more of said transporting, transporting passengers from said intermediate stop floor with an elevator car to the second floor. The invention relates also to an elevator system implementing the method.

26 Claims, 1 Drawing Sheet

(56) References Cited

U.S. PATENT DOCUMENTS

| | | | | |
|---|---|---|---|---|
| 7,594,564 | B2 * | 9/2009 | Siikonen | B66B 5/021 187/290 |
| 7,621,378 | B2 * | 11/2009 | Kawai | B66B 5/024 187/313 |
| 7,669,695 | B2 * | 3/2010 | Hikita | B66B 5/024 187/284 |
| 7,677,363 | B2 * | 3/2010 | Kawai | B66B 5/021 187/313 |
| 7,926,621 | B2 * | 4/2011 | Kawai | B66B 5/024 187/313 |
| 7,954,603 | B2 * | 6/2011 | Hikita | B66B 5/024 187/284 |
| 8,245,819 | B2 * | 8/2012 | Hikita | B66B 5/024 187/314 |
| 10,106,372 | B2 * | 10/2018 | Jetter | B66B 1/2433 |
| 2011/0024239 | A1 * | 2/2011 | Kocher | B66B 5/027 187/249 |
| 2011/0272221 | A1 * | 11/2011 | Iwata | B66B 5/021 187/384 |

* cited by examiner

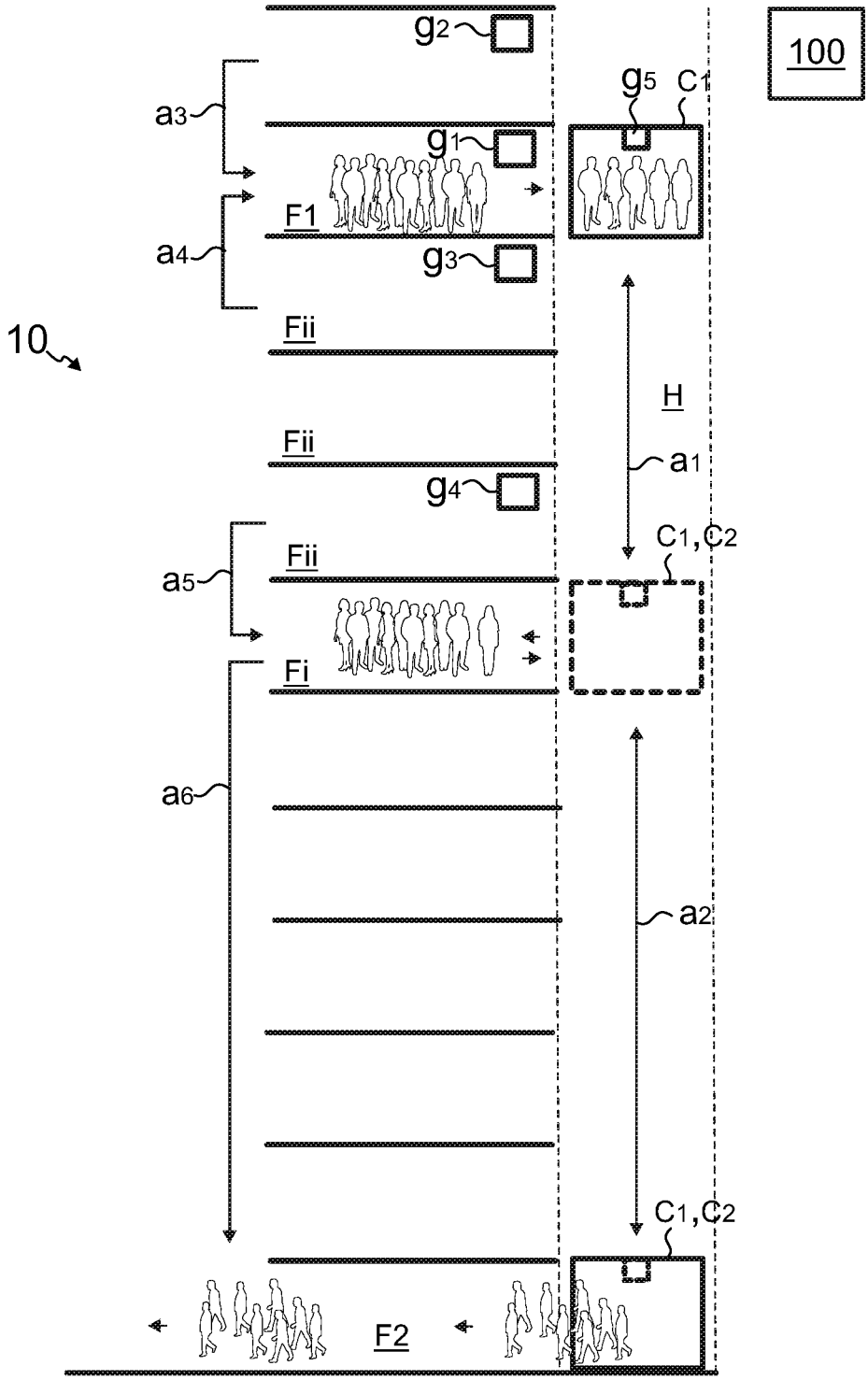
100
g2
g5
C1
a3
g1
F1
a4
g3
10
Fii
H
Fii
a1
g4
C1,C2
Fii
a5
Fi
a6
a2
C1,C2
F2

METHOD FOR USING AN ELEVATOR SYSTEM AND ELEVATOR SYSTEM HAVING FAST EMERGENCY EVACUATION OF A FLOOR

CROSS REFERENCE TO RELATED APPLICATIONS

This application is a Continuation of PCT International Application No. PCT/FI2014/050472, filed on Jun. 12, 2014, which is hereby expressly incorporated by reference into the present application.

FIELD OF THE INVENTION

The invention relates to a method for using an elevator system in which method the elevator system is used for evacuation in a building, and to an elevator system having one or more elevator cars and implementing said method.

BACKGROUND OF THE INVENTION

An elevator system typically comprises one or more elevator cars installed in a building to travel vertically in a hoistway. In larger buildings, it is typical that there are several elevator cars serving the floors of the building. There are numerous different configurations in which elevator cars can be arranged relative to each other. Usually, there are several elevator cars traveling in parallel hoistways, but also configurations are known where elevator cars travel in a common hoistway. The higher the building is, the longer is the distance that people need to pass when exiting the building. Especially in tower buildings, people coming from the uppermost floors need to pass a long way to exit the building.

In the event that one or more floors of the building is on fire, people need to be evacuated from that floor and usually also from the floors close to it. In some cases, a major portion of the building, or even the whole building, needs to be evacuated. In prior art, elevator cars have been used to transport people directly from the evacuation floor(s) to the safe exit floor(s). A drawback of the known solutions is that if the floor to be evacuated is far from a safe floor, such as the exit floor of the building (typically the ground floor), round-trip time of the elevators from the evacuation floor to the safe floor and back may be too long for evacuating all people safely and in time. The higher the building, the longer the round trip times typically are. Long round trips times easily results in mediocre capacity. Also, the last ones of the people (also referred to as passengers) located at the most risky floors may need to wait relatively long for an elevator to pick them up and transport away.

BRIEF DESCRIPTION OF THE INVENTION

The object of the invention is, inter alia, to solve previously described drawbacks of known solutions and problems discussed later in the description of the invention. The object of the invention is to introduce a method and an elevator system implementing the method, where evacuation of one or more floors of a building can be made more efficient. An object is particularly to make it possible that the most risky/dangerous zone of the building, such as the most risky/dangerous floor or floors, can be evacuated very fast. Embodiments are presented, inter alia, where especially the most risky/dangerous floors can be evacuated very fast in the cases where fire or some other threat is local (e.g. only one floor or a few floors).

It is brought forward a new method for using an elevator system in which method the elevator system is used for evacuation in a building having several vertically spaced floors, which are served or can be set to be served by an elevator system, particularly by one or more vertically traveling elevator cars of the elevator system. Said floors comprise at least a first floor, a second floor and a plurality of intermediate floors positioned vertically between the first and second floor. The elevator system is configured to have several modes, including at least a normal operating mode and an evacuation operating mode, in which normal operating mode a car of the elevator system is used to serve a first set of floors, and in which evacuation operating mode said elevator car is used to serve a second set of floors different from said first set of floors. The method comprises evacuating passengers from the first floor to the second floor, the evacuating comprises changing the mode of the elevator system from the normal operating mode to the evacuation operating mode; and determining the second set of floors to include the first floor and an intermediate stop floor from amongst the plurality of intermediate floors or a subset thereof; and transporting a load of passengers from the first floor with said elevator car without intermediate stops to said intermediate stop floor; and repeating one or more times said transporting a load of passengers from the first floor; and after one or more of said transporting, transporting passengers from said intermediate stop floor with an elevator car to the second floor. With the method one or more of the objectives are achieved. In the method, an intermediate stop floor between evacuation floor (the first floor) wherefrom people are to be evacuated, and a safe floor (second floor) whereto people are to be evacuated can be determined during the method. The floors of the second set of floors can be selected to suit best for each individual emergency taking into account the prevailing circumstances. Thereby, the method is adaptable to provide optimal result for different evacuation situations. Said safe floor may be the exit floor of the building, but it can alternatively be some other floor wherefrom people can be further evacuated, such as a skylobby-floor of the building. Each passenger can with the method be evacuated by providing him/her a trip from the first floor to the second floor, which consists of two trip legs, between which two trip legs the passenger visits the landing of the intermediate stop floor. The run from the first floor to the intermediate stop floor forms thereby the first trip leg and the run from the intermediate stop floor to the second floor forms the second of the two trip legs. By transporting passengers first to the intermediate stop floor, and not directly to the second floor, a great number of said first trip legs can be provided in a short time, thus providing an extremely effective evacuation of passengers away from the first floor, i.e. the most risky/dangerous zone. The intermediate stop floor is preferably close to the floor to be evacuated (the first floor) so that evacuation of the people takes as short time as possible but on the other hand far enough so that there is enough time to transport all people from the intermediate stop floor to the exit floor (the second floor) before for example fire spreads from the floor to be evacuated to the intermediate stop floor.

In a further refined embodiment said evacuating is initiated in response to a signal, such as an alarm signal. The signal may be in the form of an alarm signal giving an alarm of an emergency, such as a fire, for instance, or a specific evacuation command signal received from an operator.

In a further refined embodiment the determining comprises selecting an intermediate stop floor from amongst said plurality of intermediate floors or a subset thereof.

In a further refined embodiment none of the floors positioned vertically between the first floor and said intermediate stop floor are amongst the second set of floors.

In a further refined embodiment one or more floors positioned vertically between the first floor and said intermediate stop floor are amongst the first set of floors, i.e. amongst the set of floors served by the elevator car in the normal operating mode, and not amongst the second set of floors i.e. amongst the set of floors served by the elevator car in the evacuation operating mode.

In a further refined embodiment said first floor and said intermediate stop floor are both amongst the second set of floors, and one or both of said intermediate stop floor and first floor is not amongst the first set of floors.

In a further refined embodiment said intermediate floor is a floor substantially closer to the first floor than to the second floor.

In a further refined embodiment said intermediate stop floor is a floor, which is not more than X floors away from the first floor, the X being in the range of five to ten.

In a further refined embodiment said intermediate stop floor is a floor, which at least one but preferably two or more floors away from the first floor F1. Preferably, said intermediate stop floor is a floor, which is 5 to 10 floors away from the first floor.

In a further refined embodiment said intermediate stop floor is a floor between the lowermost and uppermost of the floors of the first set of floors, i.e. of the floors served by said elevator car during normal mode.

In a further refined embodiment said first floor is a floor between the lowermost and uppermost floors of the first set of floors, i.e. of the floors served by said elevator car during the normal mode In a further refined embodiment said transporting passengers with an elevator car from the first floor to an intermediate stop floor comprises moving the elevator car from the first floor to said intermediate stop floor without intermediate stops even though elevator call(s) is/are received or have been received from one or more of the floors between the first floor and said intermediate stop floor.

In a further refined embodiment said transporting passengers with an elevator car from the first floor to an intermediate stop floor comprises moving the elevator car from the first floor to said intermediate stop floor without intermediate stops even though elevator call(s) is/are received or have been received from the car.

In a further refined embodiment the evacuating comprises obtaining a passenger value representing number of passengers to be evacuated from the first floor; and determining a time limit representing the maximal allowed time for evacuating all the passengers from the first floor; and said determining the second set of floors comprises selecting an intermediate stop floor from amongst said plurality of intermediate floors or a subset thereof on the basis of said time limit and said passenger value. The selecting may comprise a step of calculating an expected time for different intermediate floors with said number of passengers/passenger value. In said selecting, the intermediate stop floor Fi is selected so close to the first floor F1 that time limit is not exceeded by said expected time.

In a further refined embodiment said transporting passengers with an elevator car from the first floor to an intermediate stop floor; and said transporting passengers from said intermediate stop floor with an elevator car to the second floor are performed consecutively with the same elevator car.

In a further refined embodiment said transporting passengers with an elevator car from the first floor to an intermediate stop floor is performed with a first elevator car and said transporting passengers from said intermediate stop floor with an elevator car to the second floor is performed with a second elevator car. Preferably, the first and second car are arranged to travel vertically in the same hoistway on top of each other, both being arranged to serve said intermediate stop floor. Then it the hoistway should extend from the level of the first floor to the level of the second floor.

In a further refined embodiment said transporting passengers with a first elevator car from the first floor to an intermediate stop floor and said transporting passengers from said intermediate stop floor with an elevator car to the second floor with a second elevator car are performed concurrently.

In a further refined embodiment the evacuating comprises guiding of the passengers, preferably by presenting information on display(s) and/or transmitting announcement(s) by speaker(s). Thus, passengers can be kept aware of what is happening, and what to do.

In a further refined embodiment said guiding comprises guiding passengers at least from floors immediately above and/or below the first floor to move to the first floor for evacuation.

In a further refined embodiment said guiding comprises presenting information at least at proximity of the elevator door of the floor(s) immediately above and/or below the first floor, preferably by presenting information on display(s) and/or transmitting announcement(s) by speaker(s) mounted at the floor at proximity of the elevator door leading from the floor in question to the hoistway.

In a further refined embodiment said guiding comprises guiding the passengers to move out from the car to the intermediate stop floor.

In a further refined embodiment said guiding comprises presenting information inside the elevator car, preferably by transmitting an announcement from speakers mounted in the car and/or presenting information on a display mounted in the car.

In a further refined embodiment said guiding comprises guiding passengers located at the first floor preferably by presenting information at least at proximity of the elevator door of the first floor, preferably by presenting information on display(s) and/or transmitting announcement(s) by speaker(s) mounted at the floor at proximity of the elevator door leading from the first floor to the hoistway.

In a further refined embodiment said transporting a load of passengers from the first floor with said elevator car without intermediate stops to said intermediate stop floor, comprises moving an elevator car to the first floor; and thereafter receiving a load of passengers from the first floor into the elevator car; and thereafter moving the elevator car without intermediate stops to said intermediate stop floor; and thereafter unloading the load of passengers received from the first floor to the intermediate stop floor.

In a further refined embodiment said transporting passengers from said intermediate stop floor with an elevator car to the second floor, comprises moving an elevator car to the intermediate stop floor, the car being the aforementioned elevator car or a second elevator car; and thereafter receiving a load of passengers from the intermediate stop floor into said elevator car; and thereafter moving said car to the second floor; and thereafter unloading the load of passengers received from the intermediate stop floor to the second floor.

In a further refined embodiment the evacuating comprises repeating said transporting passengers from said intermediate stop floor with an elevator car to the second floor.

In a further refined embodiment said second floor is the exit floor of the building or at least a floor at most 2 floors away from the ground level surrounding the building, or the skylobby of the building.

In a further refined embodiment said intermediate stop floor is below the first floor and the second floor is below the intermediate stop floor.

In a further refined embodiment said building is a tower building.

It is also brought forward a new elevator system, comprising one or more vertically traveling elevator cars installed in a building having several vertically spaced floors, said floors comprising at least a first floor, a second floor and a plurality of intermediate floors positioned vertically between the first and second floor; and having several modes, including at least a normal operating mode and evacuation operating mode; and comprising an elevator control configured to change the mode of the elevator system from the normal operating mode to an evacuation operating mode, the elevator system being configured to use in the normal operating mode the car to serve a first set of floors, and in the evacuation operating mode to serve a second set of floors, different from said first set of floors; and to change the mode of the elevator system from the normal operating mode to the evacuation operating mode; and to determine the second set of floors to include the first floor and an intermediate stop floor from amongst the plurality of intermediate floors; and to transport a load of passengers from the first floor with said elevator car without intermediate stops to said intermediate stop floor; and to repeat said transporting a load of passengers from the first floor one or more times; and to transport passengers from said intermediate stop floor with an elevator car to the second floor; and thereby evacuate passengers from the first floor to the second floor. The elevator system is preferably further configured to perform any one of the stops described above or elsewhere in the application or a set of such steps.

BRIEF DESCRIPTION OF THE DRAWINGS

In the following, the present invention will be described in more detail by way of example and with reference to the attached drawings, in which FIG. 1 illustrates schematically an elevator system according to an embodiment of the invention as viewed from the side implementing a method in accordance with the invention.

DETAILED DESCRIPTION

FIG. 1 illustrates an elevator system according to a preferred embodiment. The elevator system 10 is installed in a building having several vertically spaced floors $F_1$, $F_2$, Fi, Fii. The elevator system comprises one or more elevator cars C1,C2 traveling vertically in a hoistway H. Each of said one or more elevator cars C1,C2 has an interior space suitable for receiving a passenger or passengers, and the car is preferably provided with a door for forming a closable interior space.

The elevator system 10 comprises an elevator control 100 for controlling movement of said one or more cars of the elevator system. The elevator control 100 is preferably in the form of a control unit, which comprises a computer executing a program according to certain logic, such as one or more algorithms stored on the computer. The elevator system 10 is configured to have several different operating modes, including at least a normal operating mode and evacuation operating mode. The elevator control 100 is configured to control the elevator cars differently in these different modes, e.g. based on different algorithms. The elevator control 100 is configured to switch the mode of the elevator system from the normal operating mode to an evacuation operating mode in predetermined circumstances, such as in response to a to a signal, such as a specific evacuation command signal received from an operator or an alarm signal giving an alarm of an emergency, such as a fire, for instance. So as to control the movement of said elevator car(s) C1,C2, the elevator control 100 is connected to a power source (not showed) of each of said one or more cars, such as to a motor for moving the car in question. Numerous different elevator controls for controlling movement of elevator car(s), which have several modes, are widely known as such, whereby the structure of the elevator control 100 is not further described herein.

The elevator system illustrated in FIG. 1 implements a method for using an elevator system 10 in accordance with the following. In the method, the elevator system 10 is used for evacuation in a building having several vertically spaced floors, which are served or can be set to be served by the elevator system, particularly by one or more vertically traveling elevator cars C1,C2, said floors comprising at least a floor $F_1$ to be evacuated, and a floor $F_2$ whereto passengers are to be evacuated, and a plurality of intermediate floors Fi, Fii positioned vertically between these floors $F_1$, $F_2$. As described earlier, the elevator system is configured to have at least a normal operating mode and an evacuation operating mode. In the method, in the normal operating mode a car C1 of the elevator system is used to serve a first set of floors, i.e. the car C1 is limited to serve only certain floors forming a first set of floors. In the evacuation operating mode said elevator car C1 is used to serve a second set of floors, which second set of floors is different from said first set of floors, i.e. the car C1 is limited to serve only certain floors forming a second set of floors, which set differs from the first set. Thus, the movement of the car C1 can be optimized with different objectives in normal operating mode than in evacuation operating mode, in particular prioritizing fast transport of the passengers away from the most hazardous floor(s). Particularly, so as to realize the fast transport of the passengers away from the most hazardous floor(s) in the method certain actions are performed. In the embodiment described herein, the floor to be evacuated is the first floor F1.

In the method an evacuation is initiated in response to a need to evacuate at least one floor $F_1$. The method comprises evacuating passengers from said floor $F_1$ to be evacuated (in the following referred to as the first floor) to another floor $F_2$, which is considered safe and/or which is an exit floor of the building (in the following referred to as the second floor $F_2$). FIG. 1 illustrates an embodiment where there is a plurality of intermediate floors Fi, Fii positioned between said first floor $F_1$ and said second floor $F_2$, whereby the first and second floor are distant from each other and an effective method for evacuation is useful to ensure safety. Said evacuating is initiated preferably in response to a signal, such as an alarm signal. The signal may be in the form of an alarm signal giving an alarm of an emergency, such as a fire, for instance, or a specific evacuation command signal received from an operator. The signal preferably comprises identification information indicating a specific floor, in this case the first floor F1, to be evacuated.

Said evacuating comprises changing the mode of the elevator system from the normal operating mode to the evacuation operating mode.

The evacuating comprises determining the second set of floors to include said first floor F1 and an intermediate stop floor Fi from amongst the plurality of intermediate floors Fi, Fii or from amongst a subset of said plurality of intermediate floors Fi, Fii. Thereby the floors of the second set of floors can be selected to suit best for each individual emergency taking into account the prevailing circumstances. Thereby, the method can adapt to provide optimal result for different evacuation situations. Said intermediate floor Fi is preferably a floor substantially closer to the first floor $F_1$ than to the second floor $F_2$. After said determining, the method comprises transporting a load of passengers from the first floor F1 with said elevator car C1 without intermediate stops to said intermediate stop floor Fi, and repeating one or more times said transporting, i.e. said transporting a load of passengers from the first floor $F_1$ with said elevator car C1 without intermediate stops to said intermediate stop floor Fi.

After said transporting is performed at least one, but possibly more times, the method comprises transporting passengers from said intermediate stop floor Fi with an elevator car C1,C2 to the second floor $F_2$. With the method according to the embodiment described, each passenger is evacuated by providing him/her a trip from the first floor $F_1$ to the second floor $F_2$, which consists of two trip legs, between which trip legs the passenger visits the landing of the intermediate stop floor Fi. The run from the first floor F1 to the intermediate stop floor Fi forms thereby the first trip leg and the run from the intermediate stop floor Fi to the second floor $F_2$ forms the second of the two trip legs. By transporting passengers first to the intermediate stop floor Fi, and not directly to the second floor $F_2$, a great number of said first trip legs can be provided in a short time, thus providing an extremely effective evacuation of passengers away from the first floor $F_1$. The passengers are thus not transported directly to their final destination (second floor $F_2$), even though this could be possible, which may increase the total trip time for some individual passengers. However, the average trip time of all the passengers from the first floor $F_1$ to second floor $F_2$ can be still kept reasonable at the very least. Most importantly, the first floor $F_1$ can be emptied extremely effectively, thereby eliminating the greatest threat quickly. One advantage of the method is that it provides a relatively equal treatment for all the passengers being evacuated from floor $F_1$, particularly when compared to direct evacuation (with one trip leg only) from first floor to the second floor. Arrow $a_1$ illustrates passage of the elevator car C1 between the first floor $F_1$ and the intermediate stop floor Fi, and arrow $a_2$ illustrates passage of the elevator car (C1 or C2) between the intermediate stop floor Fi and the second floor $F_2$.

Preferably, the determining comprises selecting an intermediate stop floor Fi. Said selecting is preferably performed from amongst said plurality of intermediate floors Fi, Fii or a subset thereof. The selecting then follows a predetermined logic, preferably in the form of an algorithm programmed on the elevator control 100.

In a first alternative, the determining comprises selecting an intermediate stop floor Fi from amongst a subset of the intermediate floors Fi, Fii. In this case, the elevator system 10, particularly the elevator control 100 following said predetermined logic, is configured to select an intermediate stop floor Fi to be a floor, which is not more than X floors away from the first floor $F_1$, the X being preferably not more than ten, more preferably in the range of five to ten. the elevator system 10, particularly the elevator control 100 following said predetermined logic, is preferably also configured to delimit that the intermediate stop floor Fi is a floor, which is at least Y floors away from the first floor $F_1$, preferably at least one but preferably two or more floors away from the first floor $F_1$. In any case, it is preferable that said intermediate floor Fi is a floor substantially closer to the first floor $F_1$ than to the second floor $F_2$. In this case, all the floors included in the subset would be substantially closer to the first floor $F_1$ than to the second floor $F_2$.

In a second alternative, the elevator system 10, particularly the elevator control 100 following said predetermined logic, is configured to select dynamically an intermediate stop floor Fi from amongst said plurality of intermediate floors Fi, Fii or a subset thereof. In this case, the determining preferably comprises selecting an intermediate stop floor Fi from amongst said plurality of intermediate floors Fi, Fii or a subset thereof on the basis of a time limit and a passenger value, which time limit represents the maximal allowed time for evacuating all the passengers from the first floor, and which passenger value represents the number of passengers to be evacuated from the first floor F1. For this purpose, the evacuation comprises the step of obtaining a passenger value representing number of passengers to be evacuated from the first floor $F_1$, and obtaining a time limit representing the maximal allowed time for evacuating all the passengers from the first floor. Said number preferably comprises the number of such passengers that are arriving from other floors to the first floor $F_1$ for evacuation. The selecting may comprise a step of calculating expected time for different intermediate floors with said number of passengers/passenger value. In said selecting, the intermediate stop floor Fi is selected so close to the first floor F1 that time limit is not exceeded by said expected time. This alternative can be used simultaneously together with the aforementioned first alternative, in which case the selecting on the basis of a time limit and a passenger value is performed from amongst a subset of said plurality of intermediate floors Fi, Fii, which intermediate floors fall within a preferred range, such as the one defined above (e.g. not more than X, at least Y, Y to X, where X is 5 to 10, and Y is at least 1, preferably 2 or more).

In the method, in said determining the second set of floors the second set of floors is preferably determined such that none of the floors Fii positioned vertically between the first floor $F_1$ and said intermediate stop floor Fi are amongst the second set of floors. Thereby, the elevator car does not serve these floors. The elevator system is then configured to dismiss elevator calls received from the floors between the first floor $F_1$ and said intermediate stop floor Fi. It is preferable however, that one or more of said floors, i.e. floors Fii positioned vertically between the first floor F1 and said intermediate stop floor Fi is/are amongst the first set of floors, i.e. amongst the set of floors served by the elevator car in the normal operating mode, and not amongst the second set of floors i.e. amongst the set of floors served by the elevator car in the evacuation operating mode. In this kind of context the difference between the normal and evacuation operation modes is great. It is also possible that the first floor $F_1$ and said intermediate stop floor Fi are both amongst the second set of floors, and one or both of said intermediate stop floor Fi and first floor is not amongst the first set of floors.

It is possible that said intermediate stop floor is a floor between the lowermost and uppermost of the floors of the first set of floors, i.e. of the floors served by said elevator car C1 during normal mode. Thereby it is not the extreme floor of the elevator car C1. It is also possible that said first floor $F_1$ is a floor between the lowermost and uppermost floors served by said elevator car C1 during normal mode. In these kinds of contexts the difference between the normal and evacuation operation modes is great.

FIG. 1 illustrates two optional configurations for evacuating passengers from the first floor $F_1$ to the second floor $F_2$. The method can be carried either with one car C1 or with two cars C1, C2 as marked in FIG. 1.

In the one-car option, said transporting a load of passengers from the first floor F1 with said elevator car C1 without intermediate stops to said intermediate stop floor Fi, the subsequent repeating one or more times said transporting a load of passengers from the first floor $F_1$ with said elevator car C1 without intermediate stops to said intermediate stop floor $F_{i1}$, and said transporting passengers from said intermediate stop floor $F_{i1}$ with an elevator car C1 to the second floor $F_2$, are performed consecutively with the same elevator car C1.

More specifically, said transporting passengers with an elevator car C1 from the first floor $F_1$ to an intermediate stop floor, comprises moving an elevator car C1 to the first floor $F_1$; and thereafter receiving a load of passengers from the first floor $F_1$ into the elevator car C1; and thereafter moving the elevator car C1 without intermediate stops to said intermediate stop floor; and thereafter unloading the load of passengers received from the first floor $F_1$ to the intermediate stop floor. After this, said step of transporting a load of passengers from the first floor $F_1$ is repeated one or more times. Each repetition of said repeating one or more times said transporting a load of passengers from the first floor $F_1$ comprises repeating said moving receiving moving and unloading so as to transport further loads of passengers from first floor $F_1$ to the intermediate stop floor. Each said repeating comprises receiving a further (new) load of passengers from the first floor $F_1$ into the first elevator car, and in each repeated unloading the further load received is unloaded to the intermediate stop floor. Said unloading comprises at least opening the doorway from the car to the floor in question. In each repeated moving the elevator car to the first stop floor, the elevator car is empty while it is moved to the first stop floor.

After carrying out said transporting several times (at least two, but preferably even more), the transporting being repeated one or more times, the evacuating comprises transporting passengers from said intermediate stop floor Fi with said same elevator car C1 further to the second floor $F_2$, which comprises moving said elevator car C1 to the intermediate stop floor, the car; and thereafter receiving a load of passengers from the intermediate stop floor into said elevator car C1; and thereafter moving said car C1 to the second floor $F_2$ and thereafter unloading the load of passengers received from the intermediate stop floor to the second floor ($F_2$). After this, said step of transporting comprises transporting passengers from said intermediate stop floor Fi with an elevator car C1 to the second floor F2 is repeated one or more times. The repetition may however, not be necessary, e.g. if the second car is considerably larger than the first car and all the passengers evacuated fit in the second car. Some of the passengers may also have taken the stairs to move forward towards the second floor $F_2$ which also may render repetition unnecessary. Each repetition comprises said moving receiving moving and unloading so as to transport further loads of passengers from the intermediate stop floor to the second floor $F_2$. In each repeated receiving a further (new) load of passengers from the intermediate floor Fi is received into said elevator car C1, and in each repeated unloading the further load received is unloaded to the second floor $F_2$. In each said repeated moving of the elevator car C1 (back) to the intermediate stop floor Fi, the elevator car C1 is empty while it is moved (back) to the intermediate stop floor Fi. The hoistway in which the car C1 travels extends from the level of the first floor to the level of the second floor.

In the two-car option, there is a first car and a second car C2 that are arranged to travel vertically in the same hoistway H on top of each other, both being arranged to serve said intermediate stop floor. The hoistway H in which the cars travel extends from the level of the first floor $F_1$ to the level of the second floor $F_2$.

In this option, said transporting a load of passengers from the first floor F1 with said elevator car C1 without intermediate stops to said intermediate stop floor Fi and each of the subsequent repeatings of said transporting a load of passengers from the first floor $F_1$ with said elevator car C1 without intermediate stops to said intermediate stop floor $F_{i1}$ are performed with a first elevator car C1 and said transporting passengers from said intermediate stop floor Fi with an elevator car C1 to the second floor $F_2$, is performed with a second elevator car C2, preferably concurrently.

More specifically, said transporting passengers with an elevator car C1 from the first floor $F_1$ to an intermediate stop floor, comprises moving an elevator car C1 to the first floor F1; and thereafter receiving a load of passengers from the first floor $F_1$ into the elevator car C1; and thereafter moving the elevator car C1 without intermediate stops to said intermediate stop floor; and thereafter unloading the load of passengers received from the first floor F1 to the intermediate stop floor. After this, said step of transporting a load of passengers from the first floor $F_1$ is repeated one or more times. Each repetition of said repeating one or more times said transporting a load of passengers from the first floor $F_1$ comprises repeating said moving receiving moving and unloading so as to transport a further load of passengers from first floor $F_1$ to the intermediate stop floor. Each said repeating comprises receiving a further (new) load of passengers from the first floor $F_1$ into the first elevator car, and in each repeated unloading the further load received is unloaded to the intermediate stop floor. Said unloading comprises at least opening the doorway from the car to the floor in question. In each repeated moving the elevator car to the first stop floor, the elevator car C1 is empty while it is moved to the first stop floor.

After one or more of said transporting a load of passengers with an elevator car C1 from the first floor $F_1$ to an intermediate stop floor, the evacuating comprises transporting passengers from said intermediate stop floor Fi with a second elevator car C2. The second elevator car C2 can transport a load of passengers from the intermediate stop floor as early as right after the first car C1 has unloaded its first load of passengers in this floor and left back to transport further load from the first floor.

Transporting passengers from said intermediate stop floor Fi with the second elevator car C2 to the second floor $F_2$ comprises moving said elevator car C2 to the intermediate stop floor, and thereafter receiving a load of passengers from the intermediate stop floor into said second elevator car C2; and thereafter moving said car C2 to the second floor $F_2$ and thereafter unloading the load of passengers received from the intermediate stop floor to the second floor ($F_2$). After this, said step of transporting passengers from said intermediate stop floor Fi with an elevator car C2 to the second floor $F_2$ is repeated one or more times. The repetition may however, not be necessary, e.g. if the second car is considerably larger than the first car and all the passengers evacuated fit in the second car. Some of the passengers may also have taken the stairs to move forward towards the second floor $F_2$ which also may render repetition unnecessary. Each repetition comprises said moving receiving moving and unloading so as to transport further loads of passengers from the intermediate stop floor Fi to the second floor $F_2$. In each repeated receiving a further (new) load of passengers from the intermediate floor Fi is received into the second elevator car, and in each repeated unloading the further load received is unloaded to the second floor. In each said repeated moving the elevator car (back) to the intermediate stop floor, the elevator car is empty while it is moved to the intermediate stop floor. When the first floor $F_1$ is empty, both cars C1,C2 can be used for transporting passengers from the intermediate floor Fi towards the second floor $F_2$.

The evacuating preferably also comprises guiding of the passengers. The guiding preferably comprises presenting information on display(s) and/or transmitting announcement(s) by speaker(s). Displays/speakers are illustrated in FIG. 1 by reference numbers $g_1$, $g_2$, $g_3$, $g_4$ and $g_5$. Guiding is advantageous, because the evacuation process involves behavior from the passengers which may be unfamiliar to and/or against instincts of some of the passengers.

The guiding preferably comprises guiding passengers at least from floors immediately above and/or below the first floor $F_1$ to move to the first floor $F_1$ for evacuation. For this purpose, said guiding comprises presenting information at least at proximity of the elevator door of the floor(s) F immediately above and/or below the first floor $F_1$ in question, which door leads from the floor in question to the hoistway of the elevator. The guiding preferably comprises presenting information on display(s) $g_2$, $g_3$ and/or transmitting announcement(s) by speaker(s) $g_2$, $g_3$, mounted at the floor in question at proximity of the elevator door leading from the floor(s) in question to the hoistway H. Arrows $a_3$ and $a_4$ illustrate passage of the passengers to the intermediate stop floor Fi for evacuation e.g. by taking stairs.

The guiding preferably comprises guiding passengers at least from floors immediately above and/or below the intermediate stop floor Fi to move to the intermediate stop floor Fi for evacuation. For this purpose, said guiding comprises presenting information at least at proximity of the elevator door of the floor(s) immediately above and/or below the intermediate stop floor Fi, which door leads from the floor in question to the hoistway H of the elevator. The guiding preferably comprises presenting information on display(s) $g_4$ and/or transmitting announcement(s) by speaker(s) $g_4$ mounted at the floor in question at proximity of the elevator door leading from the floor(s) in question to the hoistway H. Arrow $a_5$ illustrates passage of the passengers to the intermediate stop floor Fi for evacuation e.g. by taking stairs. Arrow $a_6$ illustrates passage of the passengers from the intermediate stop floor Fi towards the second floor $F_2$ by taking stairs, whereby an alternative and parallel route is provided for being transported from the intermediate stop floor Fi to the second floor $F_2$ by car.

The guiding preferably comprises guiding passengers located at the first floor, preferably by presenting information at least at proximity of the elevator door of the first floor $F_1$, preferably by presenting information on display(s) $g_1$ and/or transmitting announcement(s) by speaker(s) $g_1$ mounted at the first floor $F_1$ at proximity of the elevator door leading from the first floor $F_1$ to the hoistway H.

As mentioned, the evacuating comprises receiving a load of passengers from the first floor F1 into the elevator car C1. To ensure correct subsequent behavior, the guiding preferably comprises guiding the passengers received from the first floor F1 to move out from the car C1 to the intermediate stop floor Fi. Guiding the passengers is advantageous, because the evacuation process involves exiting the car C1 at a floor Fi that is not the exit floor. So as to ensure safety of these passengers and to save capacity, it should be ensured that passengers do not travel back to the first floor F1. This guiding preferably comprises presenting information inside the elevator car C1. Said presenting information inside the elevator car C1 comprises transmitting an announcement from speakers $g_5$ mounted in the car C1 and/or presenting information on a display $g_5$ mounted in the car C1.

In both said options, said transporting passengers with an elevator car C1 from the first floor $F_1$ to an intermediate stop floor comprises moving the elevator car C1 from the first floor $F_1$ (the car C1 containing a load of passengers received from the first floor) without intermediate stops to said intermediate stop floor. The elevator system is configured to dismiss elevator calls received from the floors between the first floor $F_1$ and said intermediate stop floor Fi at least to such an amount that in said moving the car C1 the car C1 is moved from the first floor (containing a load of passengers received from the first floor) without intermediate stops to said intermediate stop floor even though elevator call(s) is/are received or have been received from one or more of the floors between the first floor $F_1$ and said intermediate stop floor Fi, i.e. no intermediate stops are done during said moving despite elevator call(s) from one or more of the floors between the first floor $F_1$ and said intermediate stop floor Fi. Correspondingly, the elevator system is configured to dismiss elevator calls received from the car C1 (e.g. so called destination calls) at least to such an amount that in said moving the car C1 the car C1 is moved from the first floor (containing a load of passengers received from the first floor) without intermediate stops to said intermediate stop floor even though elevator call(s) is/are received or have been received from the car C1, such as particularly elevator call(s) in the form of destination call(s) identifying a floor between said first floor F1 and the intermediate stop floor Fi.

The elevator system according to the invention is configured to implement the method described. Particularly, the elevator system comprises, one or more (e.g. one or two in accordance with what is described above related to the one-car option and two-car option) vertically traveling elevator cars C1,C2 installed in a building having several vertically spaced floors, said floors comprising at least a first floor $F_1$, a second floor $F_2$ and a plurality of intermediate floors Fi, Fii positioned vertically between the first and second floor $F_1$, $F_2$; and having several modes, including at least a normal operating mode and evacuation operating mode; and comprising an elevator control 100 configured to change the mode of the elevator system from the normal operating mode to an evacuation operating mode, the elevator system being configured to use in the normal operating mode a car C1 to serve a first set of floors, and in the evacuation operating mode to serve a second set of floors, different from said first set of floors, and to change the mode of the elevator system from the normal operating mode to the evacuation operating mode; and to determine the second set of floors to include the first floor $F_1$ and an intermediate stop floor Fi from amongst the plurality of intermediate floors Fi, Fii or a subset thereof; and to transport a load of passengers from the first floor $F_1$ with said elevator car C1 without intermediate stops to said intermediate stop floor Fi; and to repeat said transporting a load of passengers from the first floor $F_1$ one or more times; and to transport passengers from said intermediate stop floor Fi with an elevator car C1,C2 to the second floor $F_2$, this elevator car C1,C2 being either the car C1 that was used in the transporting a load of passengers from the first floor $F_1$ to said intermediate stop floor Fi, or another car C2. By performing these steps the elevator system is configured to evacuate passengers from the first floor $F_1$ to the second floor $F_2$.

The elevator system is preferably configured further to perform any single step described elsewhere in the application or a set of several steps, which set is described elsewhere in the application.

Said two car option is described with said cars C1 and C2 traveling in the same hoistway. However, this is not necessary as at least some of the advantages of the method can be achieved if these cars travel in parallel hoistways. However, in this case the elevator cars should be able to stop at (at least) one common floor (Fi), which means that their hoistways are at least partially side by side.

Said building is preferably a tower building, preferably a high-rise tower building. The elevator system is preferably such that said intermediate stop floor is below the first floor $F_1$ and the second floor $F_2$ is below the intermediate stop floor.

In said determining the intermediate stop floor can be selected based on one or more factors. These factors may include in addition to those presented elsewhere in the application the following factors:

number of passengers to be evacuated from the first floor,
motion times of the elevators (from floor to floor),
transport capacity of the elevator car(s),
maximal capacity of people on each lobby,
capacity of stairways.

In the application, when it is referred that a car is used to serve a floor or floors, it is meant that the car is used for receiving passengers from and/or unloading passengers to said floor or floors.

It is to be understood that the above description and the accompanying FIGURES are only intended to illustrate the present invention. It will be apparent to a person skilled in the art that the inventive concept can be implemented in various ways. The invention and its embodiments are not limited to the examples described above but may vary within the scope of the claims.

The second floor $F_2$ is preferably the exit floor of the building or at least a floor at most 2 floors away from the ground level surrounding the building. Alternatively, the second floor $F_2$ is the sky lobby of the building.

The invention claimed is:

1. A method for using an elevator system in a building having several vertically spaced floors, said elevator system comprising one or more vertically traveling elevator cars serving one or more of said floors, said floors comprising at least a first floor,
a second floor, and
a plurality of intermediate floors positioned vertically between the first and second floor,
the elevator system being configured to have several modes, including at least a normal operating mode and an evacuation operating mode, in which normal operating mode a car of the elevator system is used to serve a first set of floors, and in which evacuation operating mode an elevator car of said elevator cars is used to serve a second set of floors different from said first set of floors;
the method, upon determination that the evacuation operating mode should be implemented, comprising
quickly evacuating passengers away from the first floor and transporting them to the second floor, the evacuating comprising:
changing the mode of the elevator system from the normal operating mode to the evacuation operating mode; and
dynamically determining an intermediate stop floor from amongst the plurality of intermediate floors or a subset thereof by:
obtaining a number of passengers to be evacuated from the first floor;
obtaining a time limit representing a maximal allowed time for evacuating all passengers from the first floor;
calculating an expected time for evacuating all passengers using different intermediate floors with the number of passengers to be evacuated from the first floor; and
selecting, as the intermediate stop floor, an intermediate floor from the plurality of intermediate floors or a subset thereof which has an expected time for evacuating all passengers from the first floor to the intermediate floor that does not exceed the time limit representing the maximal allowed time for evacuating all passengers; and
transporting a load of passengers from the first floor with said elevator car without intermediate stops to the intermediate stop floor and discharging the load of passengers at the intermediate stop floor; and
repeating one or more times said transporting a load of passengers from the first floor; and
after one or more of said transporting, transporting passengers from said intermediate stop floor with an elevator car of said elevator cars to the second floor.

2. A method according to claim 1, wherein no floors positioned vertically between the first floor and said intermediate stop floor are amongst the second set of floors.

3. A method according to claim 1, wherein one or more floors positioned vertically between the first floor and said intermediate stop floor are amongst the first set of floors.

4. A method according to claim 1, wherein said first floor and said intermediate stop floor are both amongst the second set of floors, and one or both of said intermediate stop floor and first floor is not amongst the first set of floors.

5. A method according to claim 1, wherein said intermediate stop floor is a floor substantially closer to the first floor than to the second floor.

6. A method according to claim 1, wherein said intermediate stop floor is a floor, which is not more than X floors away from the first floor, the X being in the range of five to ten.

7. A method according to claim 1, wherein said intermediate stop floor is a floor between a lowermost floor and an uppermost floor of the first set of floors.

8. A method according to claim 1, wherein said first floor is a floor between a lowermost floor and an uppermost floor of the first set of floors.

9. A method according to claim 1, wherein said transporting passengers with an elevator car from the first floor to an intermediate stop floor comprises moving the elevator car from the first floor to said intermediate stop floor without intermediate stops even though elevator call(s) is/are received or have been received from one or more of floors between the first floor and said intermediate stop floor.

10. A method according to claim 1, wherein said transporting passengers with an elevator car of said elevator cars from the first floor to an intermediate stop floor comprises moving the elevator car from the first floor to said intermediate stop floor without intermediate stops even though elevator call(s) is/are received or have been received from the car.

11. A method according to claim 1, wherein said transporting passengers with an elevator car from the first floor to an intermediate stop floor; and said transporting passengers from said intermediate stop floor with an elevator car to the second floor are performed with the same elevator car.

12. A method according to claim 1, wherein said transporting passengers with an elevator car from the first floor to an intermediate stop floor is performed with a first elevator car and said transporting passengers from said intermediate stop floor with an elevator car to the second floor is performed with a second elevator car.

13. A method according to claim 12, wherein the first and second car are arranged to travel vertically in the same hoistway with one on top of the other, both being arranged to serve said intermediate stop floor.

14. A method according to claim 12, wherein said transporting passengers with a first elevator car from the first floor to an intermediate stop floor and said transporting passengers from said intermediate stop floor with the second elevator car to the second floor are performed concurrently.

15. A method according to claim 1, wherein the evacuating comprises guiding of the passengers by presenting information on one or more displays and/or transmitting one or more announcements by one or more speakers.

16. A method according to claim 15, wherein said guiding comprises guiding passengers at least from floors immediately above and/or below the first floor to move to the first floor for evacuation.

17. A method according to claim 15, wherein each elevator has an elevator door and travels in a hoistway, said guiding comprises presenting information at least at proximity of an elevator door of a floor(s) immediately above and/or below the first floor by presenting information on one or more displays and/or transmitting one or more announcements by one or more speakers mounted at a floor in proximity to the elevator door leading from the floor in question to the hoistway.

18. A method according to claim 15, wherein said guiding comprises guiding the passengers to move out from the car to the intermediate stop floor.

19. A method according to claim 18, wherein said guiding comprises presenting information inside an elevator car of said plurality of elevator cars, by transmitting an announcement from speakers mounted in the car and/or presenting information on a display mounted in the car.

20. A method according to claim 1, wherein said transporting a load of passengers from the first floor with said elevator car without intermediate stops to said intermediate stop floor, comprises moving an elevator car of said plurality of elevator cars to the first floor; and thereafter receiving a load of passengers from the first floor into the elevator car; and thereafter moving the elevator car without intermediate stops to said intermediate stop floor; and thereafter unloading the load of passengers received from the first floor to the intermediate stop floor.

21. A method according to claim 1, wherein said transporting passengers from said intermediate stop floor with an elevator car to the second floor, comprises moving a car to the intermediate stop floor, the car being the aforementioned elevator car or a second elevator car; and thereafter receiving a load of passengers from the intermediate stop floor into said car; and thereafter moving said car to the second floor; and thereafter unloading the load of passengers received from the intermediate stop floor to the second floor.

22. A method according to claim 1, wherein said second floor is an exit floor of the building or another floor at most 2 floors away from the ground level surrounding the building, or a skylobby of the building.

23. A method according to claim 1, wherein said intermediate stop floor is below the first floor and the second floor is below the intermediate stop floor.

24. A method according to claim 1, wherein said building is a tower building.

25. An elevator system, comprising one or more vertically traveling elevator cars installed in a building having several vertically spaced floors, said floors comprising at least a first floor, a second floor and a plurality of intermediate floors positioned vertically between the first and second floor; and having several modes, including at least a normal operating mode and evacuation operating mode; and comprising an elevator control configured to change the mode of the elevator system from the normal operating mode to an evacuation operating mode, the elevator system being configured to use in the normal operating mode with a car to serve a first set of floors, and in the evacuation operating mode with the car to serve a second set of floors, different from said first set of floors; and to change the mode of the elevator system from the normal operating mode to the evacuation operating mode; and dynamically determine an intermediate stop floor from amongst the plurality of intermediate floors (Fi, Fii) by:

obtaining a number of passengers to be evacuated from the first floor;

obtaining a time limit representing a maximal allowed time for evacuating all passengers from the first floor;

calculating an expected time for evacuating all passengers using different intermediate floors with the number of passengers to be evacuated from the first floor; and selecting, as the intermediate stop floor, an intermediate floor from the plurality of intermediate floors or a subset thereof which has an expected time for evacuating all passengers from the first floor to the intermediate floor that does not exceed the time limit representing the maximal allowed time for evacuating all passengers; and to transport a load of passengers from the first floor with said elevator car without intermediate stops to the intermediate stop floor and discharge them at said intermediate stop floor; and to repeat said transport a load of passengers from the first floor one or more times; and to transport passengers from said intermediate stop floor with an elevator car to the second floor;

and thereby to quickly evacuate passengers from the first floor and to discharge them at the second floor.

26. The method of claim 1 wherein the elevator system is controlled by an elevator control which implements the method.

* * * * *